US011497315B2

(12) United States Patent
Chen et al.

(10) Patent No.: US 11,497,315 B2
(45) Date of Patent: Nov. 15, 2022

(54) CHAIR FOR FITNESS EXERCISE

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 151 days.

(21) Appl. No.: 17/017,745

(22) Filed: Sep. 11, 2020

(65) Prior Publication Data

US 2021/0219731 A1 Jul. 22, 2021

(30) Foreign Application Priority Data

| | | |
|---|---|---|
| Jan. 21, 2020 | (CN) | 202010071006.3 |
| Jan. 21, 2020 | (CN) | 202020140681.2 |
| Jun. 9, 2020 | (CN) | 202010519073.7 |
| Jun. 9, 2020 | (CN) | 202021061728.2 |
| Jul. 1, 2020 | (CN) | 202021271973.6 |

(51) Int. Cl.

| | |
|---|---|
| ***A47C 9/00*** | (2006.01) |
| ***A63B 21/055*** | (2006.01) |
| ***A63B 21/16*** | (2006.01) |
| ***A63B 21/04*** | (2006.01) |
| ***A47C 1/032*** | (2006.01) |
| ***A47C 4/28*** | (2006.01) |

(Continued)

(52) U.S. Cl.

CPC ..... *A47C 9/002* (2013.01); *A47C 1/03205* (2013.01); *A47C 4/28* (2013.01); *A63B 21/0442* (2013.01); *A63B 23/12* (2013.01); *A63B 21/0552* (2013.01); *A63B 21/1609* (2015.10); *A63B 71/0036* (2013.01); *A63B 2208/0233* (2013.01); *A63B 2210/02* (2013.01)

(58) Field of Classification Search

CPC ..... A47C 1/03205; A47C 4/28; A47C 9/002; A63B 21/0442; A63B 21/0552; A63B 21/1609; A63B 21/4027; A63B 21/4033; A63B 21/4035; A63B 23/12; A63B 71/0036; A63B 2208/0233; A63B 2210/02

See application file for complete search history.

(56) References Cited

U.S. PATENT DOCUMENTS

| | | | | |
|---|---|---|---|---|
| 9,155,674 | B2 * | 10/2015 | Kim | A61H 1/0218 |
| 10,960,255 | B2 * | 3/2021 | Bourke | A63B 21/0557 |
| 11,185,165 | B2 * | 11/2021 | Chen | A47C 1/03272 |

(Continued)

*Primary Examiner* — Megan Anderson

(74) *Attorney, Agent, or Firm* — Bayramoglu Law Offices LLC

(57) ABSTRACT

A chair for fitness exercise includes a base, a stretching mechanism, a backrest, an armrest, a footrest and a supporting cushion. The stretching mechanism includes a pull rod and an elastic connector. One end of the elastic connector is fixedly connected to the base, and the other end of the elastic connector is connected to the pull rod. The base includes a footrest rod, and one end of the elastic connector is fixedly connected to the footrest rod. The backrest includes a backrest rod. The armrest is connected to the base, and an elastic assembly is fixedly arranged on the armrest. The footrest includes two side supporting rods. The supporting cushion is arranged between two side supporting rods. The elastic assembly includes a connecting rod, a first limiting member, a second limiting member, a third limiting member, a front spring, a rear spring, a first sleeve and an engaged key.

9 Claims, 8 Drawing Sheets

(51) Int. Cl.
*A63B 23/12* (2006.01)
*A63B 71/00* (2006.01)

(56) References Cited

U.S. PATENT DOCUMENTS

2013/0157818 A1* 6/2013 Lalaoua ..... A63B 21/152
482/123
2013/0157824 A1* 6/2013 Chen ..... A63B 21/4033
482/142
2019/0118024 A1* 4/2019 Thomas ..... A63B 23/1209

* cited by examiner

CHAIR FOR FITNESS EXERCISE

CROSS REFERENCE TO THE RELATED APPLICATIONS

This application is based upon and claims priority to Chinese Patent Applications No. 202010519073.7, filed on Jun. 9, 2020; No. 202021061728.2, filed on Jun. 9, 2020; No. 202021271973.6, filed on Jul. 1, 2020; No. 202010071006.3, filed on Jan. 21, 2020; No. 202020140681.2, filed on Jan. 21, 2020; the entire contents of which are incorporated herein by reference.

TECHNICAL FIELD

The present invention relates to the technical field of seats, and more particularly, to a chair for fitness exercise.

BACKGROUND

A chair is a type of seat and frequently used in people's daily lives. Nowadays, more and more people are spending long periods of time sitting on chairs. Prolonged sitting has side effects on people's health. Moreover, people don't have enough leisure time to go to fitness facilities to exercise during the course of their day. Chairs in the prior art, however, only provide a sitting function for users and thus cannot meet the fitness needs of the users.

SUMMARY

In view of the above-mentioned technical problems, an objective of the present invention is to enable people to exercise when sitting on a chair. Specifically, the present invention provides a chair for fitness exercise.

The technical solution adopted by the present invention for solving the above-mentioned technical problems is as follows. A chair for fitness exercise includes a base and a stretching mechanism.

The stretching mechanism includes a pull rod and an elastic connector. One end of the elastic connector is fixedly connected to the base, and the other end of the elastic connector is connected to the pull rod.

Preferably, the base includes a footrest rod, and one end of the elastic connector is fixedly connected to the footrest rod.

Preferably, the chair for fitness exercise further includes a backrest and an armrest. The armrest is connected to the base, and an elastic assembly is fixedly arranged on the armrest.

The backrest and the base are pivotally connected through a first rotating shaft. The backrest and the elastic assembly are pivotally connected through a second rotating shaft. The elastic assembly is configured to provide an elastic force when the backrest swings around the first rotating shaft.

Preferably, the backrest includes a backrest rod. The backrest rod is pivotally connected to the base through the first rotating shaft, and the backrest rod is pivotally connected to the elastic assembly through the second rotating shaft.

The chair for fitness exercise further includes a footrest. The footrest includes a side supporting rod, and the end of the side supporting rod is pivotally connected to the base. The footrest rod is connected between two side supporting rods. The end of the backrest rod is connected to the side supporting rod through a linkage rod, and both ends of the linkage rod are pivotally connected to the side supporting rod and the backrest rod, respectively.

Preferably, the elastic assembly includes a connecting rod, a first limiting member, a second limiting member, a third limiting member, a front spring and a rear spring. The first limiting member is fixedly connected to the armrest. One end of the connecting rod is pivotally connected to the backrest rod through the second rotating shaft, and the other end of the connecting rod passes through the first limiting member and is fixedly connected to the second limiting member. The first limiting member is slidably fitted with the connecting rod. The third limiting member, located between the first limiting member and the second limiting member, is slidably fitted with the connecting rod. The front spring is sleeved on the connecting rod and located between the second limiting member and the third limiting member. The rear spring is sleeved on the connecting rod and located between the first limiting member and the third limiting member. The stiffness coefficient of the rear spring is larger than or smaller than the stiffness coefficient of the front spring. When the second limiting member moves toward the first limiting member, the front spring is compressed by the second limiting member and the third limiting member, and the rear spring is compressed by the third limiting member and the first limiting member.

Preferably, the armrest is provided with a first adjusting part, and the base includes a second adjusting part connected to the first adjusting part.

The first adjusting part cooperates with the second adjusting part so that the armrest can move relative to the base and can be locked at a plurality of positions.

The backrest is linked with the armrest. When the armrest is locked at different positions, the backrest rotates to a corresponding inclined angle.

Preferably, the second adjusting part is a locking pin, and the first adjusting part includes an adjusting cavity enclosed by a surface. The locking pin is inserted into the adjusting cavity. The adjusting cavity includes a first channel configured for the locking pin to move and a plurality of recesses configured for the locking pin to embed. a surface forming the recesses is configured to lock the locking pin.

Preferably, the elastic assembly further includes a first sleeve and an engaged key. The first sleeve is fixed on the armrest and provided with a cavity. One end of the cavity is provided with an opening, and the other end of the cavity is provided with a blocking member. The first sleeve is provided with a limiting hole adjacent to the opening, and the first limiting member is provided with a limiting slot.

One end of the connecting rod is fixed to the second limiting member and inserted into the cavity of the first sleeve from the opening and is stopped by the blocking member. The engaged key is inserted into the limiting hole and the limiting slot.

Preferably, the chair for fitness exercise further includes a supporting cushion arranged between the two side supporting rods, and a storage bag and a bag cover are arranged on the supporting cushion.

One end of the storage bag is provided with an opening, and the bag cover is configured to cover on the opening. The other end of the storage bag is provided with a bag hole configured for the elastic connector to pass through.

Preferably, the elastic connector is fixedly connected to the pull rod through an adjusting belt, and an adjusting buckle for adjusting the maximum distance between the elastic connector and the pull rod is arranged on the adjusting belt.

Preferably, the base further includes a front supporting leg, a rear supporting leg and an middle frame. The upper end of the front supporting leg and the upper end of the rear supporting leg are pivotally connected through a first hinge member, and the locking pin is arranged on the first hinge member. The rear supporting leg is pivotally connected to a second hinge member, and the backrest rod is pivotally connected to the second hinge member through the first rotating shaft. The middle frame is pivotally connected to the front supporting leg and the backrest rod, respectively. The middle frame and the backrest rod are pivotally connected through the first rotating shaft. The side supporting rod is pivotally connected to the middle frame.

The present invention has the following advantages. A stretching mechanism is arranged on the base of the chair for fitness exercise, and the stretching mechanism includes a pull rod and an elastic connector. When sitting on the chair for fitness exercise, users can use the stretching mechanism for fitness in their leisure time.

BRIEF DESCRIPTION OF THE DRAWINGS

The present invention is further explained with reference to the drawings and embodiments below.

Figure 1:
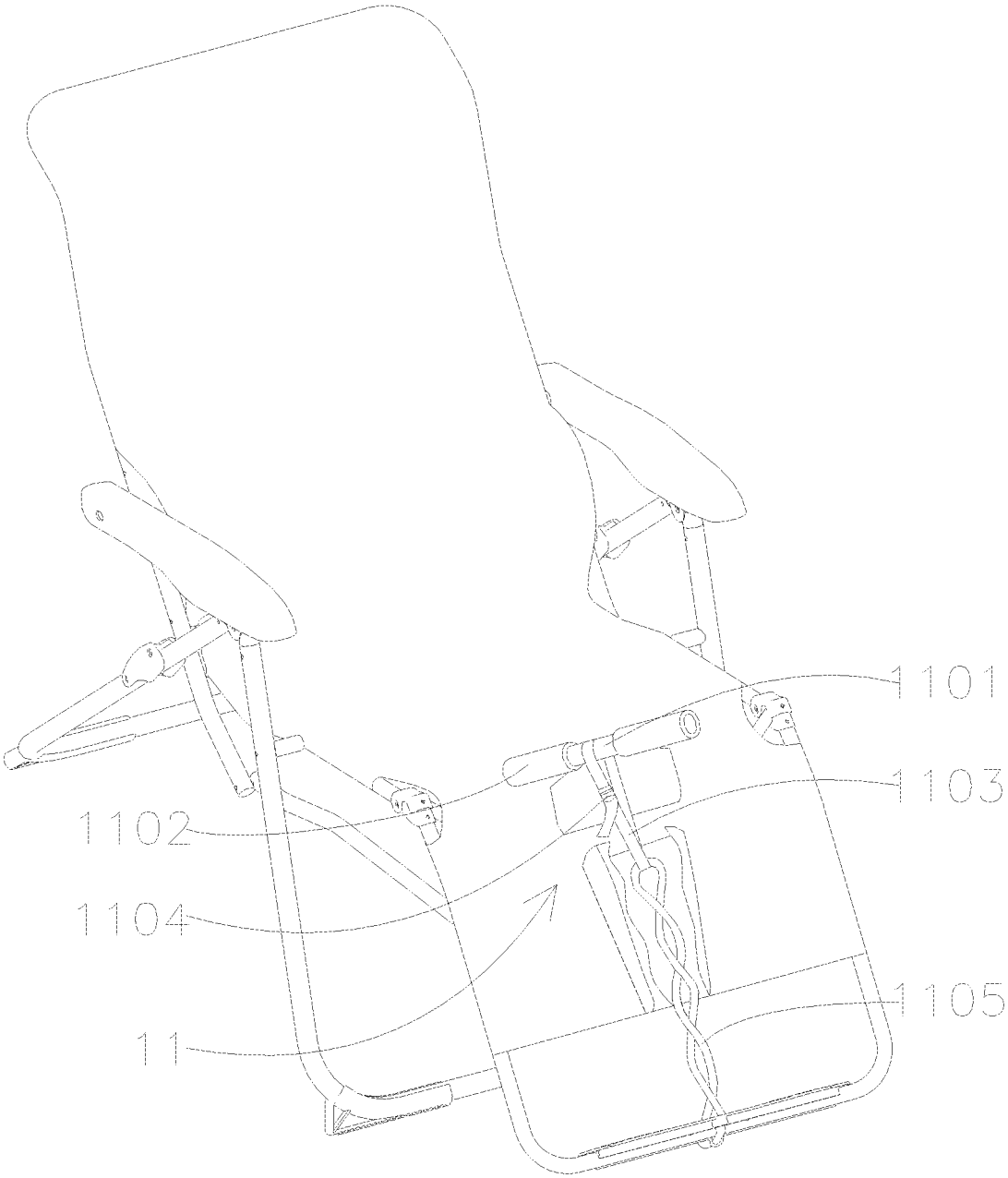
FIG. 1 is a schematic view of the structure of the chair for fitness exercise according to a preferred embodiment of the present invention.

In the figures: 1—base, 101—front supporting leg, 102—rear supporting leg, 103—middle frame, 104—first hinge member, 105—locking pin, 2—first rotating shaft, 3—backrest, 301—backrest rod, 4—armrest, 401—adjusting cavity, 4011—first channel, 4012—recess, 501—first sleeve, 502—engaged key, 503—connecting rod, 504—first limiting member, 5041—limiting slot, 505—second limiting member, 506—third limiting member, 507—front spring, 508—rear spring, 509—blocking member, 6—linkage rod, 7—second hinge member, 8—second rotating shaft, 9—footrest rod, 10—side supporting rod, 11—stretching mechanism, 1101—pull rod, 1102—grip, 1103—adjusting belt, 1104—adjusting buckle, 1105—elastic connector, 12—storage bag, 13—bag cover.

DETAILED DESCRIPTION OF THE EMBODIMENTS

The invention is described in detail below, and examples of embodiments are shown in the drawings, wherein the same or similar reference numerals throughout represent the same or similar components or the elements with the same or similar function. The following embodiments described with reference to the drawings are exemplary and only used to explain the present invention but cannot be construed as a limitation to the present invention.

In the description of the present invention, it should be understood that the orientation or positional relationship indicated by the terminologies "center", "longitudinal", "lateral", "length", "width", "thickness", "up/upward", "down/downward", "front", "back", "left", "right", "vertical", "horizontal", "top", "bottom", "inside", "outside", "axial", "radial" and "circumferential" is based on the orientation or positional relationship shown in the drawings, which is only for the convenience of describing the present invention and simplifying the description, rather than indicating or implying that the device or element referred to must have a specific orientation and be constructed and operated in a specific direction, and therefore cannot be construed as a limitation to the present invention.

In addition, the terms "first" and "second" are used only for descriptive purposes and cannot be construed as indicating or implying relative importance. In the description of the present invention, it should be stated that, unless otherwise clearly specified and defined, the terminology "connection/be connected to" should be understood in a broad sense, for example, it can be a fixed connection, a detachable connection, an integral connection, a mechanical connection, an electrical connection, a direct connection, or an indirect connection through an intermediate medium. For those having ordinary skill in the art, the specific meaning of the above expressions in the present invention can be understood according to specific circumstances. In addition, in the description of the present invention, unless otherwise stated, "a plurality of" means the number of two or more.

Figure 2:
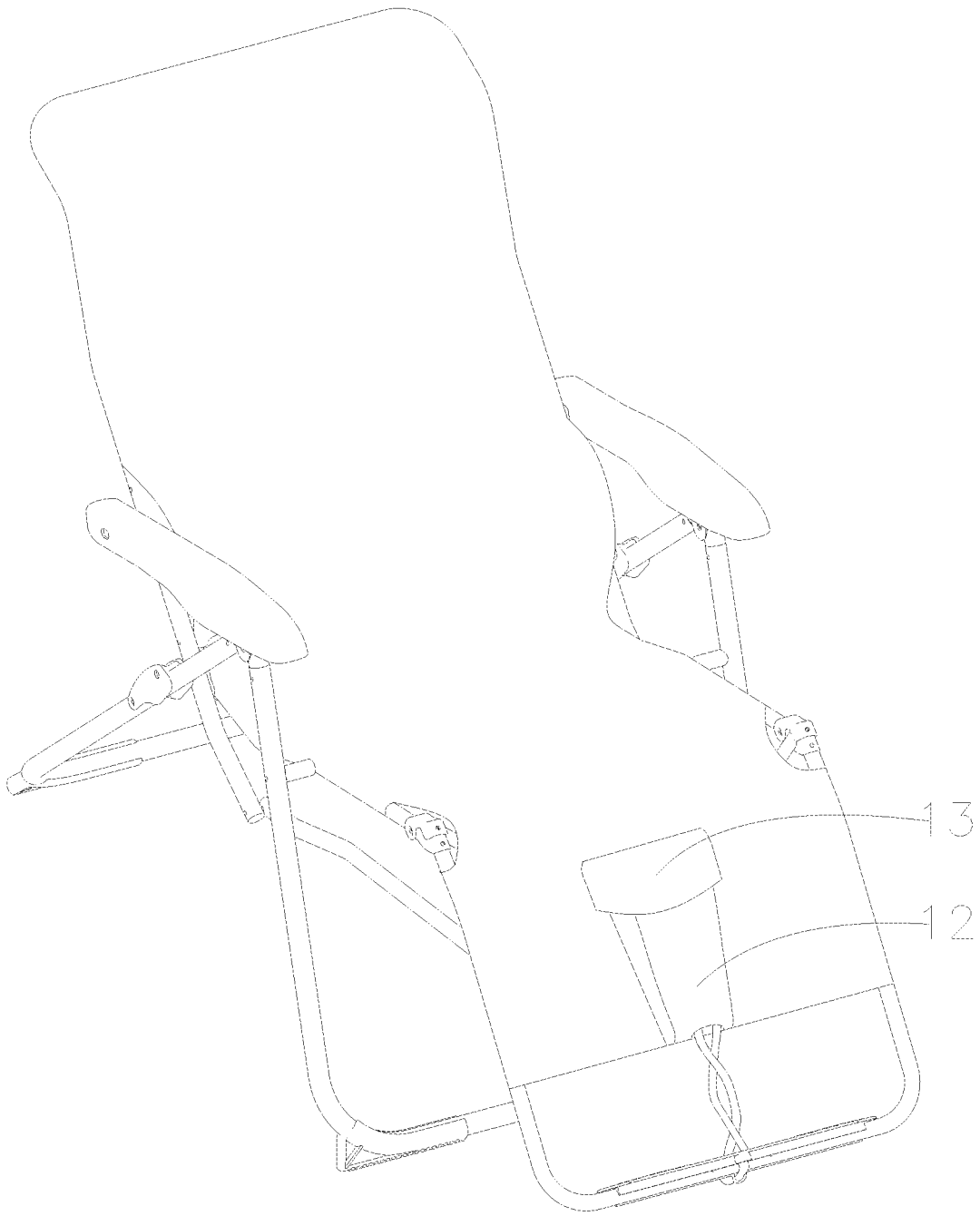
FIG. 2 is another schematic view of the structure of the chair for fitness exercise according to the preferred embodiment of the present invention.
Figure 3:
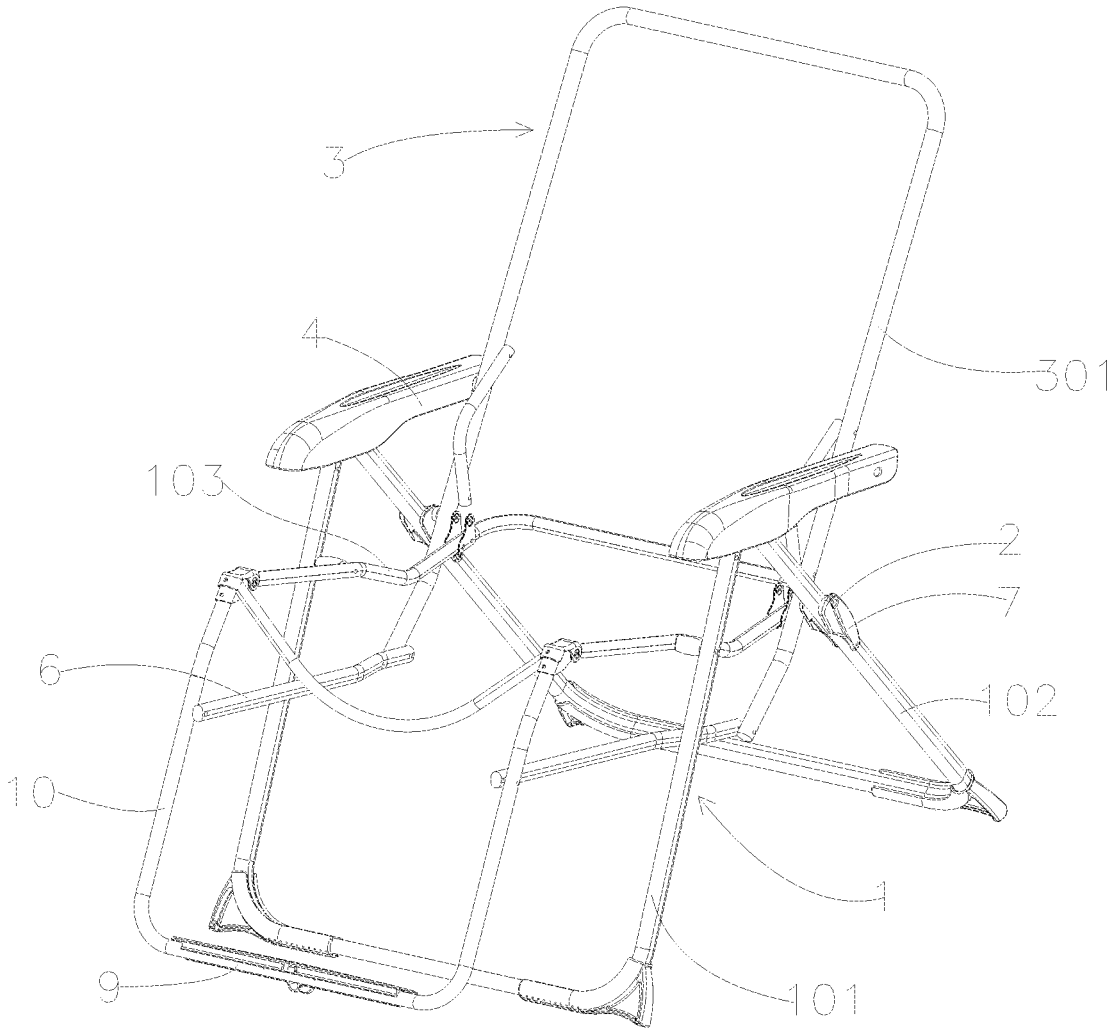
FIG. 3 is a schematic view of the frame structure of the chair for fitness exercise according to the present invention.
Figure 4:
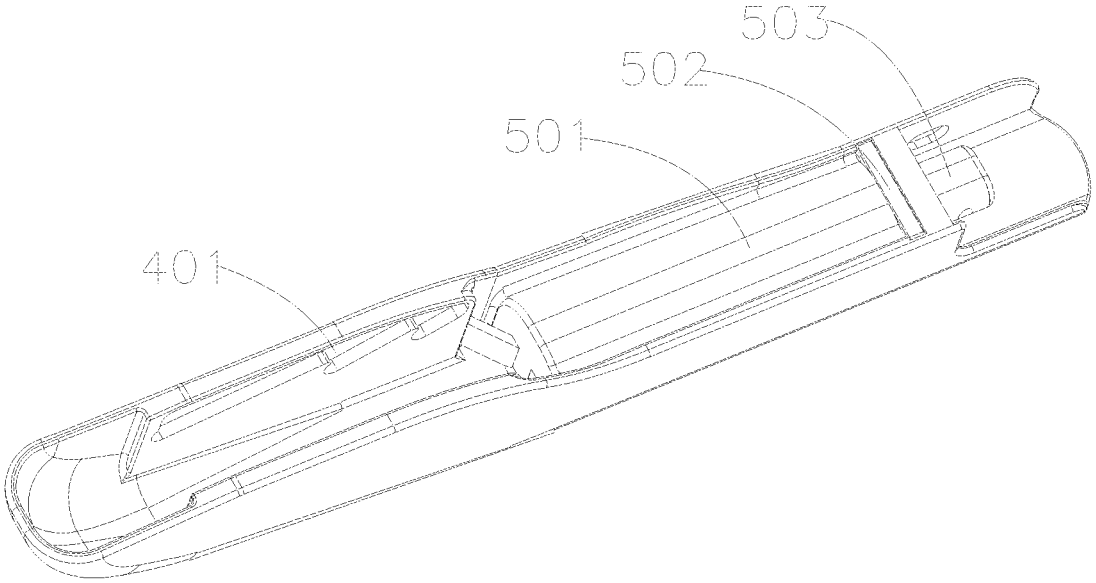
FIG. 4 is a partial structural schematic view of the chair for fitness exercise according to the present invention.
Figure 5:
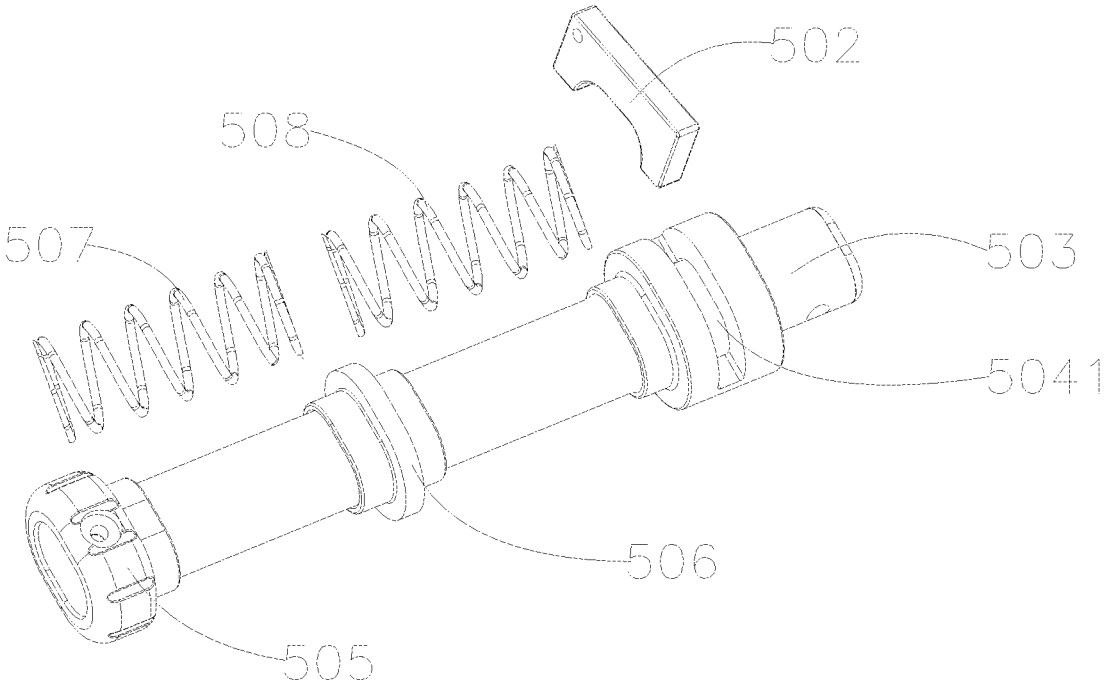
FIG. 5 is a partial exploded view of the chair for fitness exercise according to the present invention.
Figure 6:
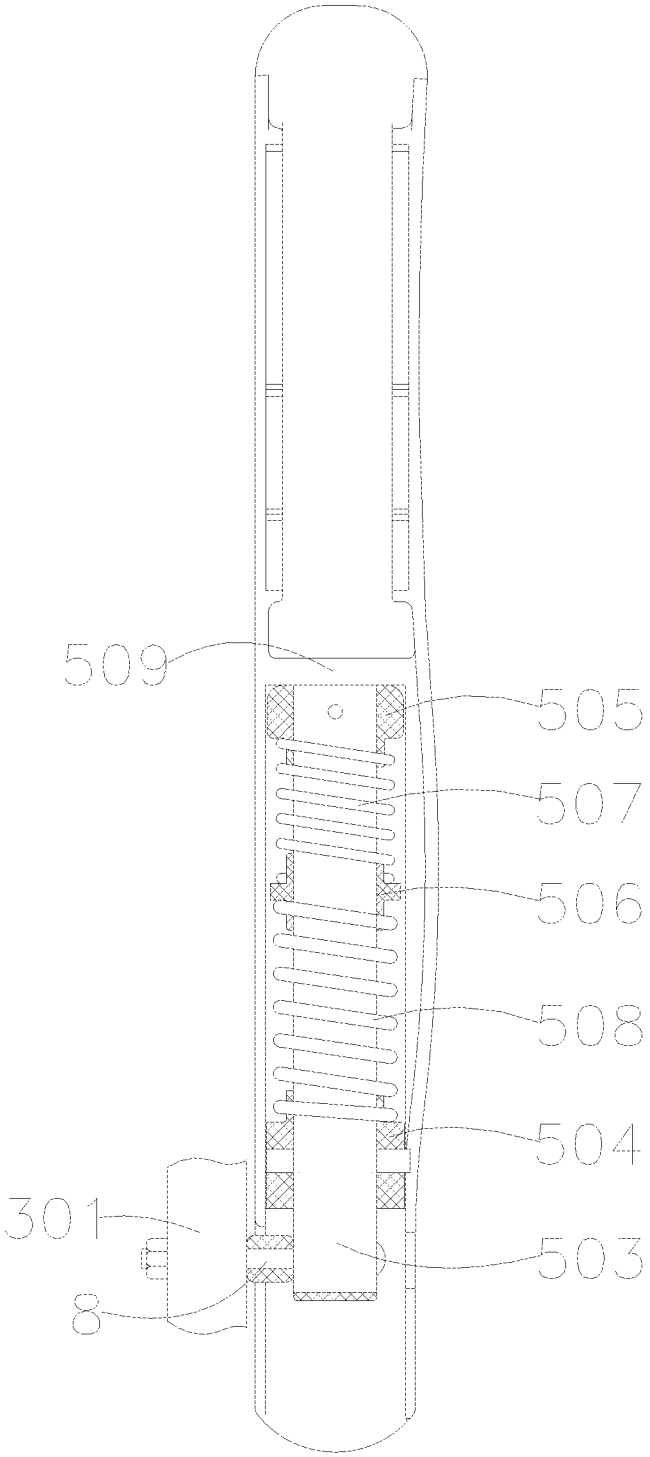
FIG. 6 is a cross-sectional view of the partial structure of the chair for fitness exercise according to the present invention.
Figure 7:
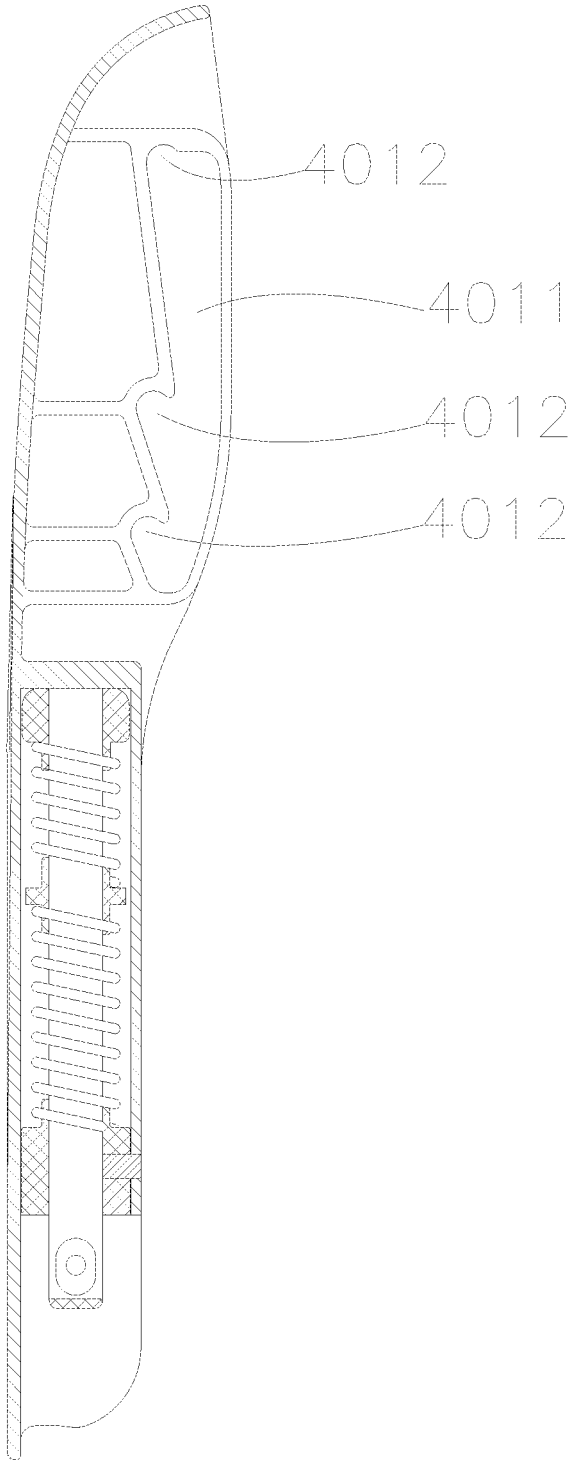
FIG. 7 is another cross-sectional view of the partial structure of the chair for fitness exercise according to the present invention.
Figure 8:
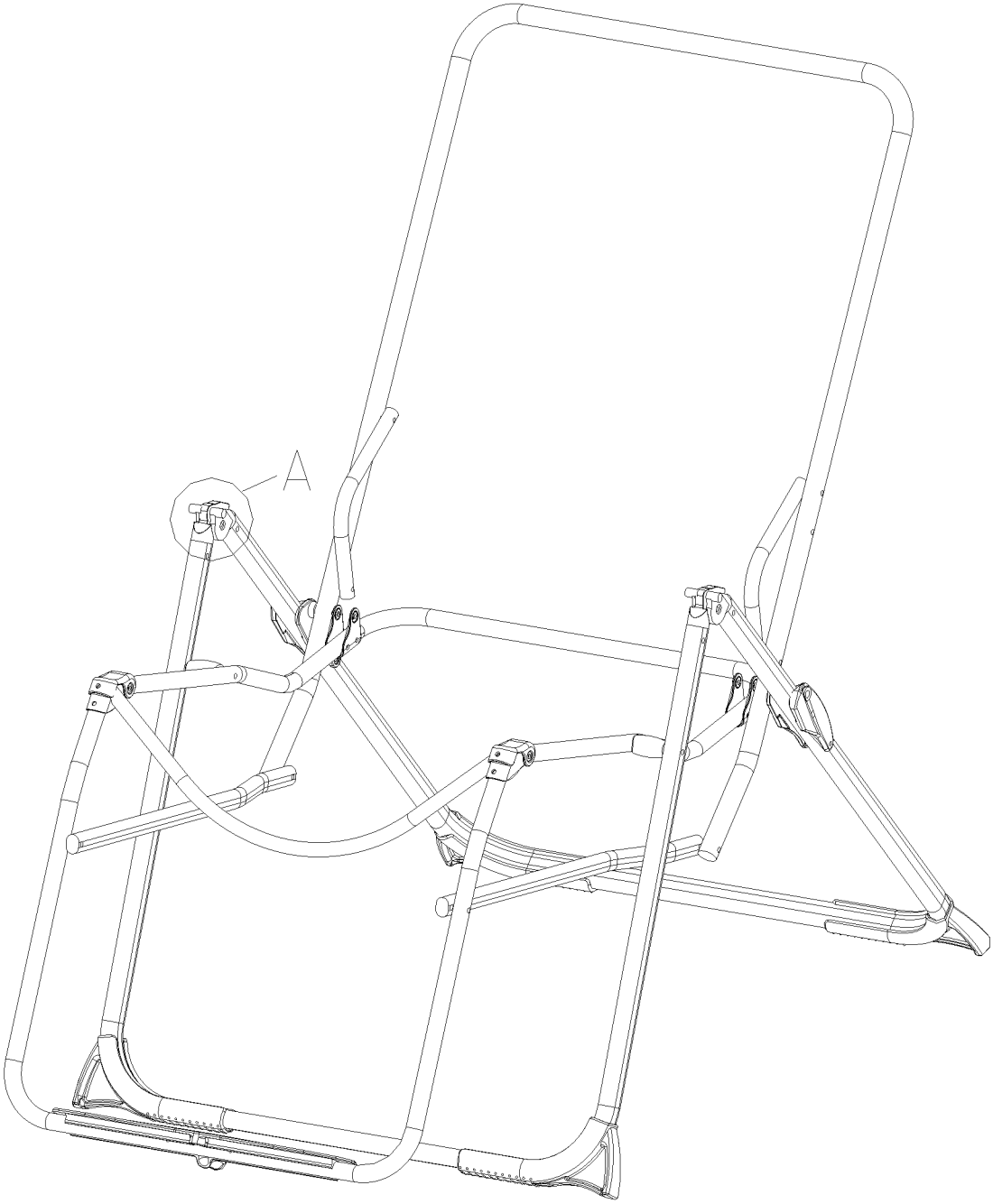
FIG. 8 is a partial structural schematic diagram of the frame structure of the chair for fitness exercise according to the present invention.
Figure 9:
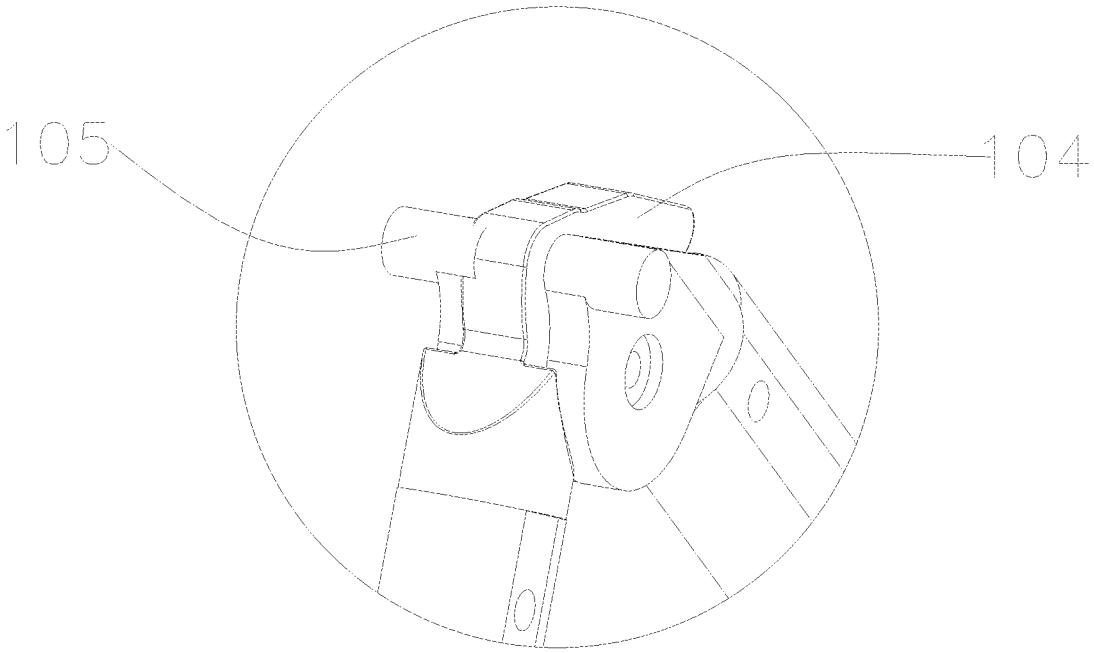
FIG. 9 is an enlarged view of the portion A encircled in FIG. 8.

As shown in FIGS. 1-9, the present invention provides a chair for fitness exercise, including the base 1, the backrest 3 pivotally connected to the base 1 through the first rotating shaft 2, and the armrest 4 connected to the base 1. In the present embodiment, the chair is a folding chair.

The base 1 includes the footrest rod 9, and the stretching mechanism 11 is arranged at the front of the base 1.

The stretching mechanism 11 includes the pull rod 1101 and the elastic connector 1105. In the present embodiment, the elastic connector 1105 is a connector capable of undergoing elastic deformation, such as an elastic rope, a spring, and the like. One end of the elastic connector 1105 is fixedly connected to the footrest rod 9, and the other end of the elastic connector 1105 is connected to the pull rod 1101 through the adjusting belt 1103. One end of the adjusting belt 1103 and the pull rod 1101 are fixedly connected between the two grips 1102, and the other end of the adjusting belt 1103 is fixed to the other end of the elastic connector 1105. In the present embodiment, the adjusting buckle 1104 is arranged on the adjusting belt 1103.

The user can grasp the two grips 1102 with both hands to grip the pull rod 1101, while the user's feet can rest on the footrest rod 9. When the user pulls the pull rod 1101 upward for fitness exercise, the pressure applied by the user's body on the base 1 can keep the base 1 stable, and the pressure applied by the user's feet on the footrest rod 9 can ensure the stability of the footrest rod 9.

The user can change the maximum distance between the pull rod 1101 and the elastic connector 1105 through the adjusting buckle 1104. As the maximum distance decreases, the distance that the pull rod 1101 moves when the user pulls the pull rod 1101 upward increases, the elastic deformation of the elastic connector 1105 increases and the pulling force that the user is subjected to increases. Conversely, As the maximum distance increases, the distance that the pull rod 1101 moves when the user pulls the pull rod 1101 upward decreases, the elastic deformation of the elastic connector 1105 decreases and the pulling force that the user is subjected to decreases. The user can adjust the intensity of fitness by adjusting the maximum distance.

The base 1 further includes the front supporting leg 101, the rear supporting leg 102 and the middle frame 103. The upper end of the front supporting leg 101 and the upper end of the rear supporting leg 102 are pivotally connected through the first hinge member 104. When the chair is unfolded, the front supporting leg 101 and the rear supporting leg 102 support the armrest 4. The backrest 3 includes two backrest rods 301 which are arranged symmetrically. The middle frame 103 is pivotally connected to the front supporting leg 101 and the backrest rod 301, respectively. The middle frame 103 and the backrest rod 301 are pivotally connected through the first rotating shaft 2. The rear supporting leg 102 is pivotally connected to the second hinge member 7. The backrest rod 301 is pivotally connected to the second hinge member 7 through the first rotating shaft 2.

A footrest is arranged at the front of the base 1, and the footrest includes two side supporting rods 10. The footrest rod 9 is fixed between the two side supporting rods 10. The upper end of the side supporting rod 10 is pivotally connected to the middle frame 103. The lower end of the backrest rod 301 is connected to the side supporting rod 10 through the linkage rod 6. Both ends of the linkage rod 6 are pivotally connected to the side supporting rod 10 and the backrest rod 301, respectively.

Two elastic assemblies are arranged on two armrests 4, respectively. The elastic assembly includes the first sleeve 501, the engaged key 502, the connecting rod 503, the first limiting member 504, the second limiting member 505, the third limiting member 506, the front spring 507 and the rear spring 508.

The first sleeve 501 fixed on the armrest 4 is provided with a cavity. One end of the cavity is provided with an opening, and the other end of the cavity is provided with the blocking member 509. In the present embodiment, the blocking member 509 is part of the first sleeve 501. In other embodiments, the blocking member 509 may be a member, which is independent of the first sleeve 501 and fixedly connected to the first sleeve 501 or other parts of the armrest 4. The first sleeve 501 is provided with the limiting hole adjacent to the opening, and the first limiting member 504 is provided with the limiting slot 5041. One end of the connecting rod 503 is fixedly connected to the second limiting member 505 and inserted into the cavity of the first sleeve 501. The other end of the connecting rod 503 passes through the first limiting member 504 and is pivotally connected to the backrest rod 301 through the second rotating shaft 8. After the chair for fitness exercise is unfolded, the second rotating shaft 8 is located above the first rotating shaft 2, and the first limiting member 504 is slidably fitted with the connecting rod 503. The third limiting member 506 located between the first limiting member 504 and the second limiting member 505 is slidably fitted with the connecting rod 503. The front spring 507 is sleeved on the connecting rod 503, and both ends of the front spring 507 are connected to the second limiting member 505 and the third limiting member 506, respectively. The rear spring 508 is sleeved on the connecting rod 503, and both ends of the rear spring 508 are connected to the first limiting member 504 and the third limiting member 506, respectively. The stiffness coefficient of the rear spring 508 is larger than or smaller than the stiffness coefficient of the front spring 507.

In the present embodiment, during the assembling process of the elastic assembly, the first limiting member 504 is forcibly pressed into the cavity of the first sleeve 501 so that the limiting slot 5041 corresponds to the limiting hole, and then the engaged key 502 is inserted into the limiting slot 5041 along the limiting hole from the outside of the sleeve to fix the first sleeve 501 to the first limiting member 504. Since the second limiting member 505 abuts against the blocking member 509, the front spring 507 and the rear spring 508 are slightly compressed, so that the first limiting member 504 and the engaged key 502 are subjected to a certain pressure to prevent the engaged key 502 from being disengaged from the limiting hole and the limiting slot 5041.

When the user sits on the chair for fitness exercise while reclining on the backrest 3, the backrest 3 is forced to swing backward around the first rotating shaft 2, the connecting rod 503 is pulled out from the opening by the second rotating shaft 8, and the second limiting member 505 also moves toward the opening. Since the first limiting member 504 is fixed, the front spring 507 and the rear spring 508 are compressed to provide elastic force for the backrest 3. When the user rises, the restoring force of the springs resets the backrest 3. In the present embodiment, under the condition that the stiffness coefficient of the rear spring 508 is larger than the stiffness coefficient of the front spring 507, when the rear spring 508 and the front spring 507 are subjected to the same pressure, the deformation of the front spring 507 is larger than the deformation of the rear spring 508. Thus, when the user is lighter in weight or sits straightly, the force applied to the backrest 3 is relatively small, and the deformation of the rear spring 508 is relatively small. In this case, the swing amplitude of the backrest 3 is mainly provided by the deformation of the front spring 507. In the present embodiment, under the condition that the stiffness coefficient of the rear spring 508 is smaller than the stiffness coefficient of the front spring 507, when the rear spring 508 and the front spring 507 are subjected to the same pressure, the deformation of the front spring 507 is smaller than the deformation of the rear spring 508. Thus, when the user is lighter in weight or sits straightly, the force applied to the backrest 3 is relatively small, and the deformation of the front spring 507 is relatively small. In this case, the swing amplitude of the backrest 3 is mainly provided by the deformation of the rear spring 508.

When the user pulls the pull rod 1101 upward while reclining on the backrest 3, the backrest 3 is forced to swing backward around the first rotating shaft 2. The backrest 3 can drive the footrest rod 9 to raise through the linkage rod 6 when swinging. Such design not only enables users to adjust their fitness postures, but also allows the user to exercise his/her legs, waist and upper body in the fitness process, thus improving the fitness effect.

In this regard, to allow users to adjust their sitting postures, in the present embodiment, two adjusting cavities 401 are symmetrically arranged on the inner wall of the armrest 4, and the adjusting cavity 401 is enclosed by a surface. The adjusting cavity 401 includes the elongated first channel 4011 and three recesses 4012 on one side of the first channel 4011. The locking pin 105 is arranged on both sides of the first hinge member 104 respectively corresponding to the two adjusting cavities 401, and the locking pin 105 is inserted into the adjusting cavity 401. The opening of the recess 4012 is tilted toward the backrest 3, and when the locking pin 105 enters the recess 4012, the backrest 3 pulls the armrest 4 backward to lock the locking pin 105 in the recess 4012.

When the user lifts the armrest 4 slightly forward and upward, the locking pin 4012 is disengaged from the recess 4012 and enters the first channel 4011, and the locking pin 105 can move in the first channel 4011. Since the length direction of the first channel 4011 is roughly in the front-rear direction, the user can move the armrest 4 forward and backward. When moving, the armrest 4 drives the backrest 3 to change the inclined angle greatly. If the user moves the armrest 4 forward and presses it slightly downward, the locking pin 105 can enter the previous recess 4012. If the user lifts the armrest 4 upward while reclining, the armrest 4 is pulled backward by the backrest 3, and in this case, the locking pin 105 enters the next recess 4012.

In the present embodiment, the number of recesses 4012 is three, and the three recesses 4012 correspond to three different sitting positions of the user, such as slightly-reclining position, semi-reclining position and supine position. When the backrest 3 is in the slightly-reclining state, the user reclines on the backrest 3. Since the back exerts a relatively small force on the backrest 3, the deformation of the front spring 507 causes a certain swing amplitude of the backrest 3, thereby providing a cushion for the user's back, while the deformation of the rear spring 508 is relatively small. When the backrest 3 is in the semi-reclining or supine state, the backrest 3 is subjected to a relatively large pressure. When the user is rocking, both the front spring 507 and the rear spring 508 produce a relatively large deformation, so that the backrest 3 can swing in a relatively large amplitude.

When the backrest 3 is in the slightly-reclining state, the semi-reclining state and the supine state, respectively, the lower end of the backrest rod 301 can raise the footrest rod 9 to a certain height through the linkage rod 6, so that the footrest rod 9 can be used in conjunction with the state of the backrest 3, which provides a comfortable experience in use.

According to other embodiments, the chair for fitness exercise further includes a chair cushion. The chair cushion includes a backrest cushion connected to the backrest 3, a seat cushion connected to the base 1, and a supporting cushion arranged between the two side supporting rods 10.

The storage bag 12 and the bag cover 13 are arranged on the supporting cushion, and the storage bag 12 and the bag cover 13 are fixedly sewn with the chair cushion. One end of the storage bag 12 away from the footrest rod 9 is provided with an opening, and the bag cover 13 can cover the opening. One end of the storage bag 12 adjacent to the footrest rod 9 is provided with a bag hole configured for the elastic connector 1105 to pass through. In the present embodiment, one end of the elastic connector 1105, which is not the end connected to the footrest rod 9, passes through the bag hole from the outside of the storage bag 12 and is then connected to the pull rod 1101.

When not needing to use the stretching mechanism 11, the user can put the pull rod 1101, the adjusting belt 1103 and a part of the elastic connector 1105 from the opening into the storage bag 12, and then cover the opening using the bag cover 13, which not only prevents the stretching mechanism 11 from affecting the sitting experience of the user, but also improves the overall look and feel of the chair for fitness exercise.

In the description of this specification, the description of the reference terminologies "one embodiment", "some embodiments", "examples", "specific examples", "some examples" and the like means that the specific features, structures or materials described in combination with the embodiment or example are included in at least one embodiment or example of the present invention. In this specification, the schematic representation of the aforementioned terminologies does not necessarily refer to the same embodiment or example. Furthermore, the specific features, structures or materials described may be combined in an appropriate manner in any one or more embodiments or examples.

Based on the description of the foregoing ideal embodiments of the present invention and the foregoing description, those skilled in the art can make various changes and modifications without deviating from the scope of the technical ideas of the present invention. The technical scope of the present invention is not limited to the contents of this specification, and must be defined according to the scope of the claims.

What is claimed is:

1. A chair for fitness exercise, comprising a base, a stretching mechanism, a backrest, and an armrest, wherein the stretching mechanism comprises a pull rod and an elastic connector; a first end of the elastic connector is fixedly connected to the base, and a second end of the elastic connector is connected to the pull rod;

the base comprises a footrest rod, and the first end of the elastic connector is fixedly connected to the footrest rod;

the armrest is connected to the base, and an elastic assembly is fixedly arranged on the armrest; and the backrest and the base are pivotally connected through a first rotating shaft; the backrest and the elastic assembly are pivotally connected through a second rotating shaft; and the elastic assembly is configured to provide an elastic force when the backrest swings around the first rotating shaft.

2. The chair for fitness exercise of claim 1, wherein the backrest comprises a backrest rod; the backrest rod is pivotally connected to the base through the first rotating shaft, and the backrest rod is pivotally connected to the elastic assembly through the second rotating shaft; and the chair for fitness exercise further comprises a footrest; the footrest comprises two side supporting rods, and an end of each side supporting rod of the two side supporting rods is pivotally connected to the base; the footrest rod is connected between the two side supporting rods; an end of the backrest rod is connected to the each of the two side supporting rods through a linkage rod, and both ends of the linkage rod are pivotally connected to the each of the two side supporting rods and the backrest rod, respectively.

3. The chair for fitness exercise of claim 2, wherein the elastic assembly comprises a connecting rod, a first limiting member, a second limiting member, a third limiting member, a front spring and a rear spring; wherein the first limiting member is fixedly connected to the armrest; a first end of the connecting rod is pivotally connected to the backrest rod through the second rotating shaft; a second end of the connecting rod passes through the first limiting member, and the second end of the connecting rod is fixedly connected to the second limiting member; the first limiting member is slidably fitted with the connecting rod; the third limiting member located between the first limiting member and the second limiting member is slidably fitted with the connecting rod;

the front spring is sleeved on the connecting rod, and the front spring is located between the second limiting member and the third limiting member; the rear spring is sleeved on the connecting rod, and the rear spring is located between the first limiting member and the third limiting member;

a stiffness coefficient of the rear spring is larger than or smaller than a stiffness coefficient of the front spring; when the second limiting member moves toward the first limiting member, the front spring is compressed by the second limiting member and the third limiting member, and the rear spring is compressed by the third limiting member and the first limiting member.

4. The chair for fitness exercise of claim 3, wherein the armrest is provided with a first adjusting part, and the base comprises a second adjusting part connected to the first adjusting part;

the first adjusting part cooperates with the second adjusting part; the armrest moves relative to the base and the armrest is locked at a plurality of positions; and the backrest is linked with the armrest; when the armrest is locked at the plurality of positions, the backrest rotates to inclined angles corresponding to the plurality of positions.

5. The chair for fitness exercise of claim 4, wherein the second adjusting part is a locking pin, and the first adjusting part comprises an adjusting cavity enclosed by a surface; the locking pin is inserted into the adjusting cavity;

the adjusting cavity comprises a first channel and a plurality of recesses; the locking pin moves in the first channel, and the locking pin is embedded into the plurality of recesses; and a surface forming the plurality of recesses is configured to lock the locking pin.

6. The chair for fitness exercise of claim 5, wherein the elastic assembly further comprises a first sleeve and an engaged key; the first sleeve is fixed on the armrest, and the first sleeve is provided with a cavity; a first end of the cavity is provided with a first opening, and a second end of the cavity is provided with a blocking member; the first sleeve is provided with a limiting hole, and the limiting hole is adjacent to the first opening; the first limiting member is provided with a limiting slot; and the second end of the connecting rod is inserted into the cavity of the first sleeve from the first opening, and the second end of the connecting rod is stopped by the blocking member; and the engaged key is inserted into the limiting hole and the limiting slot.

7. The chair for fitness exercise of claim 6, further comprising a supporting cushion arranged between the two side supporting rods, wherein a storage bag and a bag cover are arranged on the supporting cushion; and a first end of the storage bag is provided with a second opening, and the bag cover is configured to cover the second opening; a second end of the storage bag is provided with a bag hole, and the elastic connector passes through the bag hole.

8. The chair for fitness exercise of claim 7, wherein the elastic connector is fixedly connected to the pull rod through an adjusting belt, and an adjusting buckle for adjusting a maximum distance between the elastic connector and the pull rod is arranged on the adjusting belt.

9. The chair for fitness exercise of claim 8, wherein the base further comprises a front supporting leg, a rear supporting leg and a middle frame; wherein an upper end of the front supporting leg and an upper end of the rear supporting leg are pivotally connected through a first hinge member, and the locking pin is arranged on the first hinge member;

the rear supporting leg is pivotally connected to a second hinge member, and the backrest rod is pivotally connected to the second hinge member through the first rotating shaft;

the middle frame is pivotally connected to the front supporting leg and the backrest rod, respectively; the middle frame and the backrest rod are pivotally connected through the first rotating shaft; and the each side supporting rod is pivotally connected to the middle frame.

* * * * *